US010492527B2

(12) United States Patent
Liu et al.

(10) Patent No.: US 10,492,527 B2
(45) Date of Patent: Dec. 3, 2019

(54) ATOMIZER OF ELECTRONIC CIGARETTE AND ELECTRONIC CIGARETTE

(71) Applicant: CHINA TOBACCO HUNAN INDUSTRIAL CO., LTD., Changsha, Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Jianhua Yi, Hunan (CN); Hong Yu, Hunan (CN); Yongquan Zhou, Hunan (CN)

(73) Assignee: CHINA TOBACCO HUNAN INDUSTRIAL CO., LTD., Changsha, Hunan (CN)

( * ) Notice: Subject to any disclaimer, the term of this patent is extended or adjusted under 35 U.S.C. 154(b) by 0 days.

(21) Appl. No.: 15/578,588

(22) PCT Filed: Jun. 22, 2016

(86) PCT No.: PCT/CN2016/086659
§ 371 (c)(1),
(2) Date: Nov. 30, 2017

(87) PCT Pub. No.: WO2017/206212
PCT Pub. Date: Dec. 7, 2017

(65) Prior Publication Data

US 2019/0053537 A1 Feb. 21, 2019

(30) Foreign Application Priority Data

Jun. 3, 2016 (CN) ..... 2016 1 03900504

(51) Int. Cl.
*A24F 13/00* (2006.01)
*A24F 17/00* (2006.01)
(Continued)

(52) U.S. Cl.
CPC ..... *A24F 47/004* (2013.01); *A24F 47/002* (2013.01); *A24F 47/008* (2013.01); *B05B 17/0607* (2013.01)

(58) Field of Classification Search
CPC .... A24F 47/004; A24F 47/002; A24F 47/008; B05B 17/0607
(Continued)

(56) References Cited

U.S. PATENT DOCUMENTS

2006/0196518 A1* 9/2006 Hon ..... A24F 47/002 131/360
2007/0267031 A1* 11/2007 Hon ..... A24F 47/008 131/273
(Continued)

FOREIGN PATENT DOCUMENTS

CN 103919279 * 7/2014 ..... A24F 47/00
CN 103919279 A 7/2014
(Continued)

OTHER PUBLICATIONS

International Search Report issued in International Application No. PCT/CN2016/086659 dated Mar. 2, 2017, 4 pages.

*Primary Examiner* — Abdullah A Riyami
*Assistant Examiner* — Thang H Nguyen
(74) *Attorney, Agent, or Firm* — Mauriel Kapouytian Woods LLP; James Woods

(57) ABSTRACT

Embodiments of the present invention disclose an atomizer of electronic cigarette and electronic cigarette. The atomizer comprises a housing; the housing is in fixed connection with a suction nozzle; an ultrasonic atomization piece is fixed in the housing; the ultrasonic atomization piece comprises a solid piezoelectric ceramic piece; one surface of the solid piezoelectric ceramic piece is in contact with a liquid guide structure, and the other surface thereof is in contact with solid perfume; the liquid guide structure communicates with
(Continued)

a tobacco tar storage cavity; both of the liquid guide structure and the solid perfume communicate with an airflow passage; and an air inlet of the airflow passage communicates with the outside of the housing, and an outlet of the airflow passage communicates with the suction nozzle.

18 Claims, 5 Drawing Sheets

(51) Int. Cl.
*A24F 25/00* (2006.01)
*A24F 47/00* (2006.01)
*B05B 17/06* (2006.01)

(58) Field of Classification Search
USPC ..... 131/329, 328
See application file for complete search history.

(56) References Cited

U.S. PATENT DOCUMENTS

| | | | | |
|---|---|---|---|---|
| 2016/0143360 | A1* | 5/2016 | Sanchez | A24F 47/008 239/302 |
| 2016/0198770 | A1* | 7/2016 | Alarcon | A24F 47/008 392/404 |
| 2017/0071251 | A1* | 3/2017 | Goch | A24F 47/008 |

FOREIGN PATENT DOCUMENTS

| | | | |
|---|---|---|---|
| CN | 204466914 | U | 7/2015 |
| CN | 105192894 | A | 12/2015 |
| CN | 204907924 | U | 12/2015 |
| CN | 105559151 | A | 5/2016 |
| CN | 205233465 | U | 5/2016 |
| CN | 205671480 | U | 11/2016 |
| JP | 2001069963 | A | 3/2001 |

* cited by examiner

ATOMIZER OF ELECTRONIC CIGARETTE AND ELECTRONIC CIGARETTE

CROSS REFERENCE TO RELATED APPLICATIONS

This application is a national phase application of international application number PCT/CN2016/086659 filed on Jun. 22, 2016, which claims priority to Chinese application number 2016103900504 filed on Jun. 3, 2016. The entire contents of these applications are hereby incorporated herein by reference.

TECHNICAL FIELD

The present invention relates to an atomizer of electronic cigarette and electronic cigarette.

BACKGROUND ART

The taste of the existing electronic cigarette has great difference with that of the cigarette on the market, thereby affecting the popularity and promotion of the electronic cigarette. Currently, common solution is to heat and atomize tobacco tar by using heating wires to produce smoke, but the taste of the smoke has a great difference with that of the real cigarette, thereby failing to meet users' demands; meanwhile the heating wires in the electronic cigarette require high power to atomize the tobacco tar to the smoke, thereby being likely to produce the burnt flavor, resulting in that the smoking taste becomes worse. Moreover, the structure of the existing electronic cigarette is complicated, and the tobacco tar is easy to leak. Thus, to meet the market demands, it is necessary to develop electronic cigarette that has the taste of the real cigarette to fill in the gap in the market and improve the user experience of the electronic cigarette.

CONTENTS OF INVENTION

The technical problem to be solved in the present invention is to provide an atomizer of electronic cigarette and electronic cigarette in view of the shortcomings of the prior art.

To solve the above-mentioned technical problem, the present invention adopts the technical solutions as follows: an atomizer of electronic cigarette comprises a housing; the housing is in fixed connection with a suction nozzle; an ultrasonic atomization piece is fixed in the housing; the ultrasonic atomization piece comprises a solid piezoelectric ceramic piece; one surface of the solid piezoelectric ceramic piece is in contact with a liquid guide structure, and the other surface thereof is in contact with solid perfume, so that the solid piezoelectric ceramic piece can not only atomize tobacco tar to produce smoke in a working process, but also transfer the heat generated by itself in the working process to the solid perfume, making the solid perfume to release fragrance; the liquid guide structure communicates with a tobacco tar storage cavity; both of the liquid guide structure and the solid perfume communicate with an airflow passage; and an air inlet of the airflow passage communicates with the outside of the housing, and an outlet of the airflow passage communicates with the suction nozzle, so that the smoke is mixed with the fragrance and is inhaled by a user through the suction nozzle.

In the present invention, the solid perfume comprises a cigarette material, a tobacco extract, essence and a humectant; and the weight ratio of the cigarette material, the tobacco extract, the essence and the humectant is 1:0.1-0.5:0.001-0.005:2-6.

The plane where the solid piezoelectric ceramic piece is located is parallel to the center axis of the housing, therefore, when the atomizer of electronic cigarette is vertically placed on a horizontal plane, the radial direction of the solid piezoelectric ceramic piece is vertical to the horizontal plane, namely, the solid piezoelectric ceramic piece is vertically arranged in the housing, therefore the tobacco tar on the solid piezoelectric ceramic piece will not accumulate on the surface of the solid piezoelectric ceramic piece, and thus a higher starting speed of the atomizer can be guaranteed.

In a preferred technical solution of the present invention, the liquid guide structure comprises a liquid guide body and a liquid storage piece which is in contact with one surface of the solid piezoelectric ceramic piece; the liquid storage piece is in contact with one end of the liquid guide body; the other end of the liquid guide body stretches into the liquid storage cavity; the liquid guide body comprises a connecting part which has matched shape and size with those of the liquid storage piece and has opposite position to that of the same, and a liquid guide part stretching into the liquid storage cavity and connected with the connecting part; and at least one projection which is in contact with the liquid storage piece is provided on the connecting part. The projection props against the liquid storage piece to reserve a gap between the liquid guide body and the liquid storage piece, thereby ensuring that the airflow passing through the gap carries smoke and the airflow passage is smooth.

The connecting part is fixed in a fixing base, a notch is provided in the fixing base, and the liquid guide part extends into the liquid storage cavity from the notch. Therefore, the liquid guide part absorbs the tobacco tar in the liquid storage cavity and supplies the tobacco tar to the solid piezoelectric ceramic piece to be atomized.

Both of the ultrasonic atomization piece and the liquid storage piece are fixed in a bracket; the fixing base is connected with one side of the bracket which is close to the liquid storage piece; a perfume fixing base is provided on one side of the bracket which is away from the liquid storage piece; a cavity, namely a filling cavity, is provided between the perfume fixing base and the solid piezoelectric ceramic piece; the filling cavity is filled with the solid perfume; an air inlet hole and an air outlet hole, which are located at opposite positions and communicate with the solid perfume, are respectively provided in the bracket on the upper side and the lower side of the filling cavity; and the air outlet hole communicates with the suction nozzle, so that the airflow enters the filling cavity from the air inlet hole to discharge the fragrance in the filling cavity from the air outlet hole.

An air inlet is provided in the housing; a first gap is provided between the liquid storage piece and the liquid guide body, and one side of the first gap communicates with the air inlet; and the other side of the first gap communicates with the air inlet hole, so that the smoke produced by atomizing the tobacco tar by the solid piezoelectric ceramic piece is taken away by the airflow.

The liquid storage cavity is provided below the solid piezoelectric ceramic piece and the liquid guide body; a cavity cover is provided at the top end of the liquid storage cavity; one surface of the cavity cover which is away from the liquid storage cavity is connected with a side edge of a hollow cavity with an open upper end, and a limiting step is provided on the inner wall of the hollow cavity; the outer wall at the bottom of the bracket is connected with the inner wall of the limiting step; a first through hole is provided at a contact position of the bracket and the hollow cavity; the first gap communicates with the air inlet hole by the first through hole; and the air inlet, the first gap, the first through hole, the air inlet hole, the hollow cavity, the air outlet hole and the inner cavity of the suction nozzle form the airflow passage. Therefore, the airflow is carried into the filling cavity through the first gap to be mixed with the fragrance at first, making the taste of the smoke to be the same as the taste of real cigarette, and thus user's demands can be satisfied.

An installation through hole is provided in one side of the cavity cover; and the liquid guide part of the liquid guide body stretches into the liquid storage cavity after penetrating through the installation through hole. Therefore, the installation of the liquid guide body is more stable, and tobacco tar leakage is prevented.

The bottom end of the liquid storage cavity is provided in a bottom cover; and the outer wall of the bottom cover is in fixed connection with the inner wall of the housing, and the connection can be a snap connection or a magnetic connection so as to facilitate the detachment of the bottom cover.

In another preferred technical solution of the present invention, the liquid storage cavity is provided above the solid piezoelectric ceramic piece; the solid piezoelectric ceramic piece is fixed in a cavity, the cavity is formed by enclosing a lower fixing base which is open at both ends and an upper fixing base whose bottom end is provided in the lower fixing base; a vent groove is provided in the inner wall of the lower fixing base; the upper surface of the solid piezoelectric ceramic piece is in contact with the liquid guide structure; the lower surface of the solid piezoelectric ceramic piece is in contact with the solid perfume; and the lower fixing base is connected with the bottom of the housing; the liquid guide structure comprises a liquid guide body; the liquid guide body comprises a main body which is in contact with one surface of the solid piezoelectric ceramic piece; at least one projection is provided on the main body; and the projection communicates with the liquid storage cavity after penetrating through the upper fixing base. The structure is relatively simple, and the tobacco tar guide speed is relatively high.

A vent pipe is provided in the liquid storage cavity; an installation part is provided at the bottom end of the vent pipe; a mounting hole which has inside diameter matched with the outside diameter of the installation part is provided in the upper fixing base; the installation part is fixed in the mounting hole, and the inner cavity of the installation part communicates with the vent groove; and the top end of the vent pipe communicates with the inner cavity of the suction nozzle. Since the airflow passage is relatively long, the mixture of the smoke and the fragrance is more evenly, and thus the taste of the smoke is better.

The lower fixing base is provided on a connecting base; a second through hole is provided in the connecting base; a net structure is provided between the second through hole and the lower fixing base; the solid perfume is placed in the hollow cavity between the net structure and the solid piezoelectric ceramic piece, and the solid perfume is in contact with the solid piezoelectric ceramic piece, so that the heat produced by the solid piezoelectric ceramic piece in the working process is absorbed by the solid perfume, and the fragrance is released accordingly; and meanwhile, the net structure can not only fix the solid perfume, but also guarantee the airflow to be unobstructed.

An electrode is installed in the second through hole; an air inlet passage with one end communicated with the outside is provided in the electrode; the air inlet passage communicates with the vent groove through the net structure and the solid perfume; and the airflow passage is formed by the air inlet passage, the net structure, the solid perfume, the vent groove, the vent pipe and the inner cavity of the suction nozzle. Since the airflow passage is relatively long, the mixture of the smoke and the fragrance is more evenly, and thus the taste of the smoke is better.

At least one air hole communicated with the solid perfume is provided in the top of the electrode, and the air hole disperses the airflow, so that all the solid perfume is in contact with the airflow, and thus the fragrance can be taken away more easily.

Correspondingly, the present invention further provides an electronic cigarette, employing any atomizer of electronic cigarette in the above-mentioned two preferred technical solutions.

Compared with the prior art, the present invention has the following beneficial effects: the tobacco tar is atomized on one surface of the ultrasonic atomization piece in the present invention, when the tobacco tar is atomized, the ultrasonic atomization piece produces heat, and the other surface of the ultrasonic atomization piece transfers the heat to the solid perfume, so that the solid perfume releases fragrance when the ultrasonic atomization piece is working, the fragrance is mixed with the smoke produced by the atomization of the tobacco tar, therefore the taste of the electronic cigarette is closer to that of the cigarette, and the energy efficiency is high; that is to say, the ultrasonic atomization piece atomizes the tobacco tar to provide the smoke (tasteless smoke), the solid perfume provides the fragrance, and the smoke is mixed with the fragrance to form smoke having the taste and smell of cigarette; meanwhile, as one surface of the ultrasonic atomization piece is in contact with the tobacco tar in the liquid guide structure, the problem that the ultrasonic atomization piece is burnt in a dry state to be damaged easily is solved to a certain extent; and in the present invention, as the ultrasonic atomization piece atomizes the tobacco tar, the atomization power is low, no burnt flavor is produced, the structure is simple, exquisite, stable and compact, and promotion and application are easy to realize.

SPECIFIC MODE FOR CARRYING OUT THE INVENTION

Figure 1:
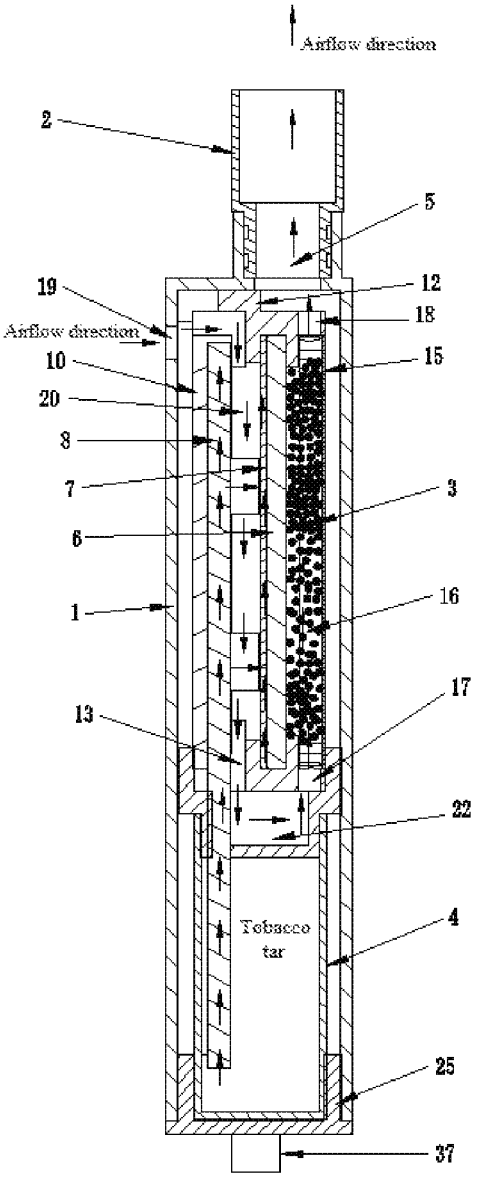
FIG. 1 is a sectional view of embodiment 1 of the present invention.

As shown in FIG. 1, embodiment 1 of the present invention comprises a housing 1; the housing 1 is in fixed connection with a suction nozzle 2; a solid piezoelectric ceramic piece 6 is fixed in the housing 1; one surface of the solid piezoelectric ceramic piece 6 is in contact with a liquid guide structure, and the other surface thereof is in contact with solid perfume 3; the liquid guide structure communicates with a tobacco tar storage cavity 4; both of the liquid guide structure and the solid perfume 3 communicate with an airflow passage 5; and an air inlet of the airflow passage 5 communicates with the outside of the housing 1, and an outlet of the airflow passage 5 communicates with the suction nozzle 2.

In the present invention, the solid perfume comprises a cigarette material, a tobacco extract, essence and a humectant, and solid perfume granules are prepared by warm air flow or convection heating or other processes and an automatic rolling mixer; and the weight ratio of the cigarette material, the tobacco extract, the essence and the humectant is 1:0.1-0.5:0.001-0.005:2-6.

The cigarette material is one or more of cut tobacco, tobacco stem, tobacco slice and tobacco foam; the humectant is a mixture of propylene glycol and glycerol; and the essence is flavored perfume in tobacco flavor essence or strawberry flavor essence.

In the present invention, the ultrasonic atomization piece is a solid piezoelectric ceramic piece.

As shown in FIG. 1, the plane where the solid piezoelectric ceramic piece 6 is located is parallel to the center axis of the housing 1; that is to say, when the atomizer of electronic cigarette is vertically placed on a horizontal plane, the solid piezoelectric ceramic piece 6 is vertically placed in the atomizer of electronic cigarette; namely, the ultrasonic atomization piece is vertically provided in the housing 1.

Figure 2:
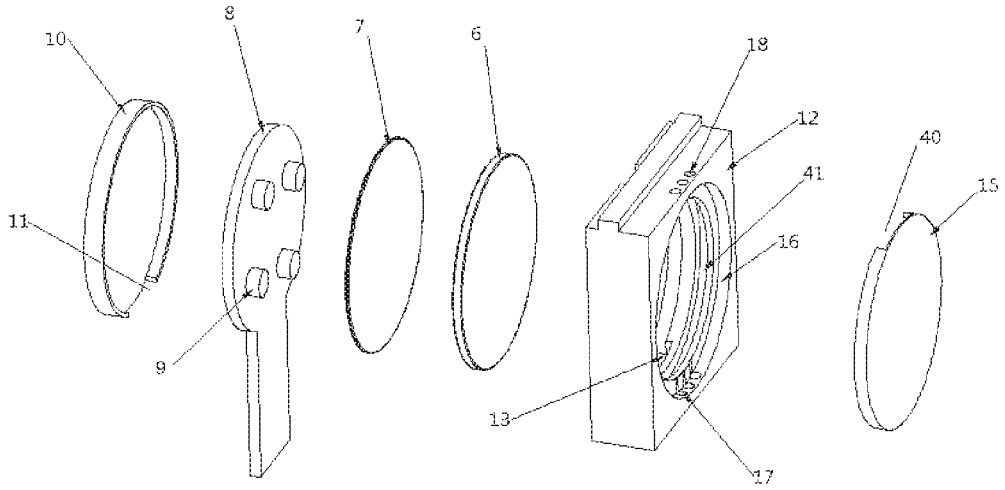
FIG. 2 is an explosive view of an atomization core in embodiment 1 of the present invention.

As shown in FIG. 2, the liquid guide structure comprises a liquid guide body 8 and a liquid storage piece 7 which is in contact with one surface of the solid piezoelectric ceramic piece 6; the liquid storage piece 7 is in contact with one end of the liquid guide body 8; the other end of the liquid guide body 8 stretches into the liquid storage cavity 4; the liquid guide body 8 comprises a connecting part which has matched shape and size with those of the liquid storage piece 7 and has opposite position to that of the same, and a liquid guide part stretching into the liquid storage cavity 4 and connected with the connecting part; and at least one projection 9 in contact with the liquid storage piece 7 is provided on the connecting part.

The connecting part is fixed in a fixing base 10, a notch 11 is provided in the fixing base 10, and the liquid guide part extends into the liquid storage cavity 4 from the notch 11. The fixing base 10 is of a disc-shaped structure, and the inner side of a side edge of the disc-shaped structure is in contact with the edge of the connecting part of the liquid guide body.

The liquid guide part of the liquid guide body is of a strip-shaped structure, the strip-shaped structure penetrates through the notch 11, and the width of the notch 11 is matched with the width of the strip-shaped structure.

As shown in FIG. 2, in the present invention, both of the solid piezoelectric ceramic piece 6 and the liquid storage piece 7 are fixed in a bracket 12; the fixing base 10 is connected with one side of the bracket 12 which is close to the liquid storage piece 7; a perfume fixing base 15 is provided on one side of the bracket 12 which is away from the liquid storage piece 7; a cavity, namely a filling cavity 16, is provided between the perfume fixing base 15 and the solid piezoelectric ceramic piece 6; the filling cavity 16 is filled with the solid perfume 3; an air inlet hole 17 and an air outlet hole 18, which are located at opposite positions and communicate with the solid perfume 3, are respectively provided in the bracket 12 on the upper side and the lower side of the filling cavity 16; and the air outlet hole 18 communicates with the suction nozzle 2.

The perfume fixing base 15 is of a disc-shaped structure, and corresponding side edges of the disc-shaped structure located on the air inlet hole 17 and the air outlet hole 18 are provided with notches 40, thereby ensuring that the airflow can enter into the filling cavity 16 through the air inlet hole 17 and can flow out from the air outlet hole 18 in the filling cavity 16.

An installation groove 41 is provided in the bracket 12, and the solid piezoelectric ceramic piece 6 and the liquid storage piece 7 are both fixed in the installation groove 41.

As shown in FIG. 1, an air inlet 19 is provided in the housing 1; the air inlet 19 communicates with a first gap 20 between the liquid storage piece 7 and the liquid guide body 8; the first gap 20 communicates with the air inlet hole 17; and the air inlet 19, the first gap 20, the air inlet hole 17, the air outlet hole 18 and the inner cavity of the suction nozzle 2 form the airflow passage 5. The smoke produced by the oscillation of the solid piezoelectric ceramic piece 6 is ejected from the surface of the liquid storage piece 7 and enters the first gap 20, and then the smoke enters the solid perfume through the air inlet hole 17 and is mixed with the fragrance produced by the solid perfume during the oscillation of the solid piezoelectric ceramic piece 6, and then the mixed smoke enters the suction nozzle through the air outlet hole 18 and is inhaled by the user.

Figure 3:
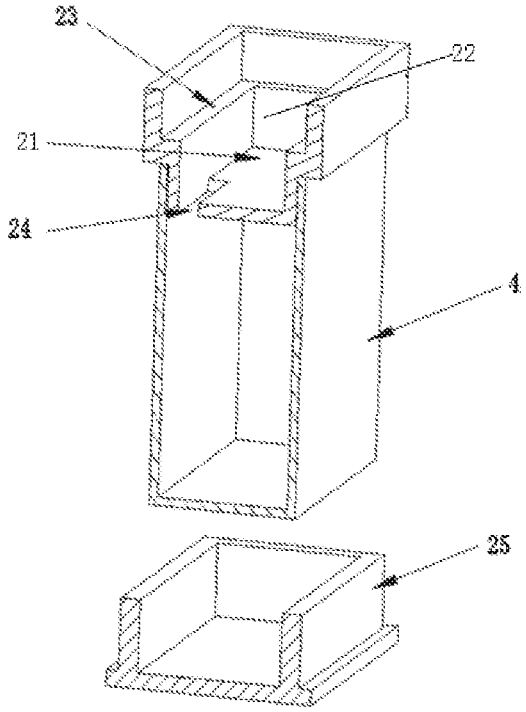
FIG. 3 is an explosive view of a liquid storage cavity and a bottom cover in the embodiment 1 of the present invention.

As shown in FIG. 3, the liquid storage cavity 4 is provided below the solid piezoelectric ceramic piece 6 and the liquid guide body 8; a cavity cover 21 is provided at the top end of the liquid storage cavity 4; one surface of the cavity cover 21 which is away from the liquid storage cavity 4 is connected with a side edge of a hollow cavity 22 which has an open upper end, and a limiting step 23 is provided on the inner wall of the hollow cavity 22; the bottom of the bracket 12 props against the limiting step 23, and a first through hole 13 is provided at a place on the bracket 12 where the bracket 12 communicates with the hollow cavity 22; and the first through hole 13 communicates the first gap 20 with the air inlet hole 17.

An installation through hole 24 is provided in one side of the cavity cover 21; and the liquid guide part of the liquid guide body 8 stretches into the liquid storage cavity 4 after penetrating through the installation through hole 24 to absorb the tobacco tar so as to provide the tobacco tar for the atomization of the solid piezoelectric ceramic piece 6.

As shown in FIG. 3, the bottom end of the liquid storage cavity 4 is provided in a bottom cover 25; and the outer wall of the bottom cover 25 is in a snap connection or a magnetic connection with the inner wall of the housing 1.

An electrode 37 is fixed to a base 25 to facilitate the electric connection with a power supply component.

Figure 4:
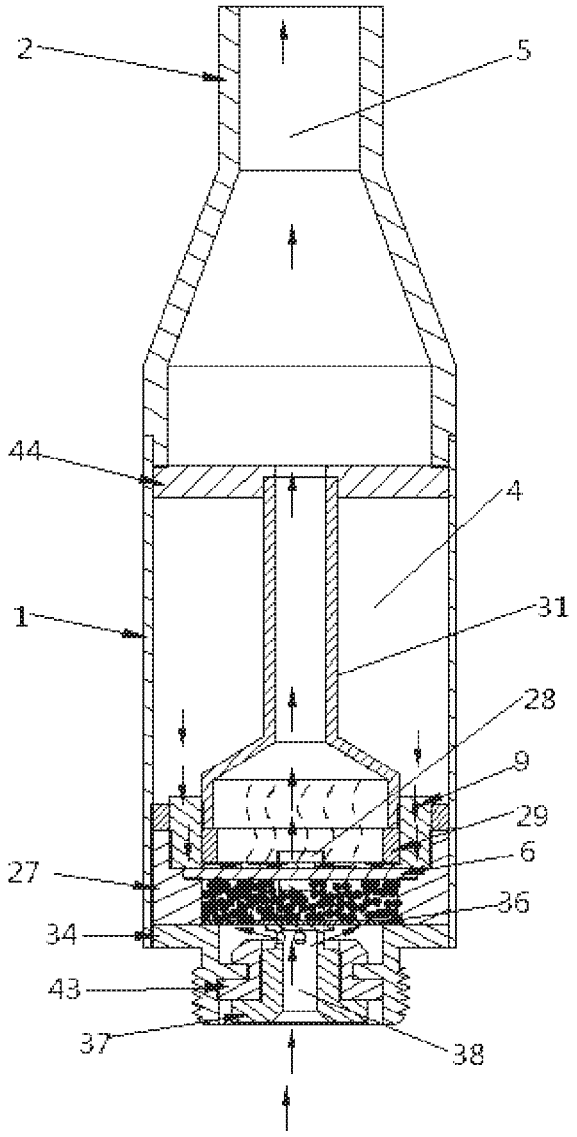
FIG. 4 is a sectional view of embodiment 2 of the present invention.
Figure 5:
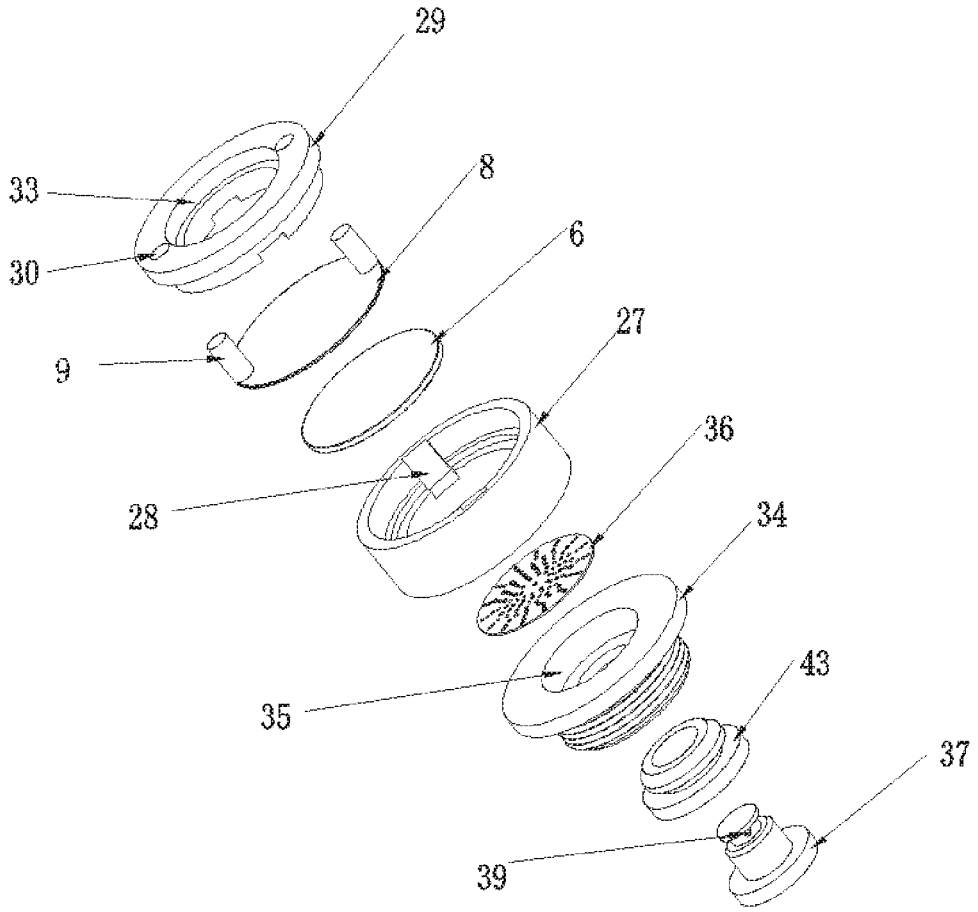
FIG. 5 is an explosive view of a structure between an upper fixing base and an electrode in embodiment 2 of the present invention.

As shown in FIG. 4 and FIG. 5, in embodiment 2, the liquid storage cavity 4 is provided above the solid piezoelectric ceramic piece 6; the solid piezoelectric ceramic piece 6 is fixed in a cavity, the cavity is formed by enclosing a lower fixing base 27 which is open at both ends and an upper fixing base 29 whose bottom end is provided in the lower fixing base 27 together; a vent groove 28 is provided in the inner wall of the lower fixing base 27; the upper surface of the solid piezoelectric ceramic piece 6 is in contact with the liquid guide structure; the lower surface of the solid piezoelectric ceramic piece 6 is in contact with the solid perfume 3; and the lower fixing base 27 is connected with the bottom of the housing 1.

The liquid guide structure comprises a liquid guide body 8; the liquid guide body 8 comprises a main body whose diameter is greater than that of the solid piezoelectric ceramic piece 6 (facilitating the connection with the upper fixing base), and the main body has a circular bottom; at least one projection 9 is provided on the edge of the circular bottom; and the projection 9 communicates with the liquid storage cavity 4 after penetrating through a tobacco tar inlet hole 30 in the upper fixing base 29.

Figure 6:
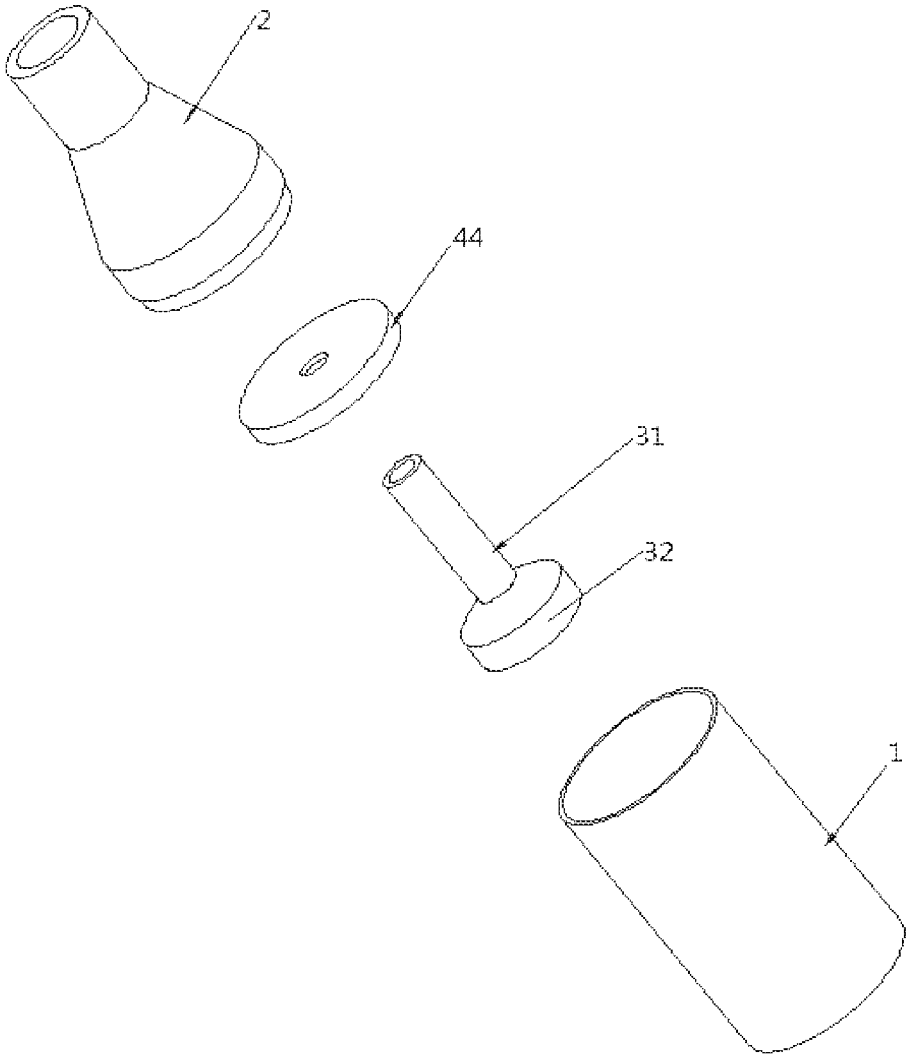
FIG. 6 is an explosive view of a structure from a suction nozzle to the liquid storage cavity in embodiment 3 of the present invention.

As shown in FIG. 4, FIG. 5 and FIG. 6, a vent pipe 31 is provided in the liquid storage cavity 4; an installation part 32 is provided at the bottom end of the vent pipe 31; a mounting hole 33 with inside diameter matched with the outside diameter of the installation part 32 is provided in the upper fixing base 29; the installation part 32 is fixed in the mounting hole 33, and the inner cavity of the installation part 32 communicates with the vent groove 28; and the top end of the vent pipe 31 communicates with the inner cavity of the suction nozzle 2.

The lower fixing base 27 is provided on a connecting base 34; a second through hole 35 is provided in the connecting base 34; a net structure 36 is provided between the second through hole 35 and the lower fixing base 27; the solid perfume 3 is placed in the hollow cavity between the net structure 36 and the solid piezoelectric ceramic piece 6, and the solid perfume 3 is in contact with the solid piezoelectric ceramic piece 6, so that the heat produced by the solid piezoelectric ceramic piece 6 in the working process is absorbed by the solid perfume 3, and the fragrance is released accordingly.

In the present invention, the net structure is a steel mesh.

An electrode 37 is installed in the second through hole 35 (the electrode 37 and the second through hole 35 are insulated and isolated by an insulation ring 43); an air inlet passage 38 with one end communicated with the outside is provided in the electrode 37; an air hole 39 communicated with the air inlet passage 38 is provided in the other end; and the air inlet passage 38 communicates with the vent groove 28 through a radial trough hole, the net structure 36 and the solid perfume 3; and the air inlet passage 38, the net structure 36, the solid perfume 3, the vent groove 28, the vent pipe 31 and the inner cavity of the suction nozzle 2 form the airflow passage 5.

External air enters from the air inlet passage 38 and flows into the solid perfume through the air hole 39 and the top end of the electrode 37, and then enters the vent pipe after being mixed with the smoke in the vent groove 28, wherein the smoke is produced by atomizing the tobacco tar by the solid piezoelectric ceramic piece 6, and finally enters the suction nozzle to be inhaled by the user.

In order to prevent the leakage of the tobacco tar of the atomizer, the connecting place of the housing 1 and the suction nozzle 2 is sealed by a sealing ring 44. Electronic cigarette of the present invention employs the atomizer of electronic cigarette of the embodiment 1 or the embodiment 2 mentioned above.

The invention claimed is:

1. An atomizer of electronic cigarette, comprising a housing which is in fixed connection with a suction nozzle, wherein an ultrasonic atomization piece is fixed in the housing; the ultrasonic atomization piece comprises a solid piezoelectric ceramic piece; one surface of the solid piezoelectric ceramic piece is in contact with a liquid guide structure, and the other surface thereof is in contact with solid perfume; the liquid guide structure communicates with a tobacco tar storage cavity; both of the liquid guide structure and the solid perfume communicate with an airflow passage; an air inlet of the airflow passage communicates with the outside of the housing, and an outlet of the airflow passage communicates with the suction nozzle.

2. The atomizer of electronic cigarette of claim 1, wherein the solid perfume comprises a cigarette material, a tobacco extract, essence and a humectant; and the weight ratio of the cigarette material, the tobacco extract, the essence and the humectant is 1:0.1-0.5:0.001-0.005:2-6.

3. The atomizer of electronic cigarette of claim 1, wherein the plane where the solid piezoelectric ceramic piece is located is parallel to the center axis of the housing.

4. The atomizer of electronic cigarette of claim 3, wherein the liquid guide structure comprises a liquid guide body and a liquid storage piece which is in contact with one surface of the solid piezoelectric ceramic piece; the liquid storage piece is in contact with one end of the liquid guide body; and the other end of the liquid guide body stretches into the liquid storage cavity.

5. The atomizer of electronic cigarette of claim 4, wherein the liquid guide body comprises a connecting part which has matched shape and size with those of the liquid storage piece and has opposite position to that of the same, and a liquid guide part stretching into the liquid storage cavity and connected with the connecting part; and at least one projection which is in contact with the liquid storage piece is provided on the connecting part.

6. The atomizer of electronic cigarette of claim 5, wherein the connecting part is fixed in a fixing base, a notch is provided in the fixing base, and the liquid guide part extends into the liquid storage cavity from the notch.

7. The atomizer of electronic cigarette of claim 6, wherein both of the solid piezoelectric ceramic piece and the liquid storage piece are fixed in a bracket; the fixing base is connected with one side of the bracket which is close to the liquid storage piece; a perfume fixing base is provided on one side of the bracket which is away from the liquid storage piece; a cavity, namely a filling cavity is provided between the perfume fixing base and the solid piezoelectric ceramic piece; the filling cavity is filled with the solid perfume; an air inlet hole and an air outlet hole, which are located at opposite positions and communicate with the solid perfume, are respectively provided in the bracket on the upper side and the lower side of the filling cavity; and the air outlet hole communicates with the suction nozzle.

8. The atomizer of electronic cigarette of claim 7, wherein an air inlet is provided in the housing; a first gap is provided between the liquid storage piece and the liquid guide body, and one side of the first gap communicates with the air inlet; and the other side of the first gap communicates with the air inlet hole.

9. The atomizer of electronic cigarette of claim 8, wherein the liquid storage cavity is provided below the solid piezoelectric ceramic piece and the liquid guide body; a cavity cover is provided at the top end of the liquid storage cavity; one surface of the cavity cover which is away from the liquid storage cavity is connected with a side edge of a hollow cavity which has an open upper end, and a limiting step is provided on the inner wall of the hollow cavity; the outer wall at the bottom of the bracket is connected with the inner wall of the limiting step; a first through hole is provided at a contact position of the bracket and the hollow cavity; the first gap communicates with the air inlet hole by the first through hole; and the air inlet, the first gap, the first through hole, the air inlet hole, the hollow cavity, the air outlet hole and the inner cavity of the suction nozzle form the airflow passage.

10. The atomizer of electronic cigarette of claim 9, wherein an installation through hole is provided in one side of the cavity cover; and the liquid guide part of the liquid guide body stretches into the liquid storage cavity after penetrating through the installation through hole.

11. The atomizer of electronic cigarette of claim 9, wherein the bottom end of the liquid storage cavity is provided in a bottom cover; and the outer wall of the bottom cover is in fixed connection with the inner wall of the housing.

12. The atomizer of electronic cigarette of claim 1, wherein the liquid storage cavity is provided above the solid piezoelectric ceramic piece; the solid piezoelectric ceramic piece is fixed in a cavity, the cavity is formed by enclosing a lower fixing base which is open at both ends and an upper fixing base whose bottom end is provided in the lower fixing base; a vent groove is provided in the inner wall of the lower fixing base; the upper surface of the solid piezoelectric ceramic piece is in contact with the liquid guide structure; the lower surface of the solid piezoelectric ceramic piece is in contact with the solid perfume; and the lower fixing base is connected with the bottom of the housing.

13. The atomizer of electronic cigarette of claim 12, wherein the liquid guide structure comprises a liquid guide body; the liquid guide body comprises a main body which is in contact with one surface of the solid piezoelectric ceramic piece; at least one projection is provided on the main body; and the projection communicates with the liquid storage cavity after penetrating through the upper fixing base.

14. The atomizer of electronic cigarette of claim 13, wherein a vent pipe is provided in the liquid storage cavity; an installation part is provided at the bottom end of the vent pipe; a mounting hole which has inside diameter matched with the outside diameter of the installation part is provided in the upper fixing base; the installation part is fixed in the mounting hole, and the inner cavity of the installation part communicates with the vent groove; and the top end of the vent pipe communicates with the inner cavity of the suction nozzle.

15. The atomizer of electronic cigarette of claim 14, wherein the lower fixing base is provided on a connecting base; a second through hole is provided in the connecting base; a net structure is provided between the second through hole and the lower fixing base; the solid perfume is placed in the hollow cavity between the net structure and the solid piezoelectric ceramic piece.

16. The atomizer of electronic cigarette of claim 15, wherein an electrode is installed in the second through hole; an air inlet passage with one end communicated with the outside is provided in the electrode; and the air inlet passage communicates with the vent groove through the net structure and the solid perfume.

17. The atomizer of electronic cigarette of claim 16, wherein at least one air hole communicated with the solid perfume is provided in the top of the electrode; and the airflow passage is formed by the air inlet passage, the air hole, the net structure, the solid perfume, the vent groove, the vent pipe and the inner cavity of the suction nozzle.

18. An electronic cigarette, wherein the electronic cigarette employs the atomizer of electronic cigarette of claim 1.

* * * * *